United States Patent [19]

McBride

[11] Patent Number: 4,534,490

[45] Date of Patent: Aug. 13, 1985

[54] INSULATED PANEL SYSTEM FOR STORAGE TANKS

[76] Inventor: Mark A. McBride, P.O. Box 1570, La Porte, Tex. 77571

[21] Appl. No.: 677,596

[22] Filed: Dec. 3, 1984

[51] Int. Cl.[3] ..... B65D 25/16; B65D 90/06

[52] U.S. Cl. ..... 220/435; 52/248; 52/249; 220/449; 220/452

[58] Field of Search ..... 220/415, 449, 452, 445, 220/435, 436, 437, 439, 468; 52/248, 249

[56] References Cited

U.S. PATENT DOCUMENTS 2,209,420 7/1940 Rutten et al. ..... 52/248

2,738,094 3/1956 Fowler ..... 220/452 X 4,044,517 8/1977 Schroter ..... 52/248

4,122,640 10/1978 Commins et al. ..... 52/248

*Primary Examiner*—Allan N. Shoap

*Attorney, Agent, or Firm*—Robert J. Marett

[57] ABSTRACT

An insulated tank jacketing system for storage tank structures of the type used for oil, water, etc., wherein insulated panel systems having upstanding and opposed side flanges are affixed to wire cables or the like on the outside wall of the tank structure by means of a continuous fastener interposed around each cable and positioned between the side flanges of adjacent panels and held in place by having the side flanges of adjacent panels rolled over each other with the fastener being locked within the closure roll thus allowing all component parts of the system, including the cable, to expand and contract relative to each other with no restriction.

12 Claims, 8 Drawing Figures

INSULATED PANEL SYSTEM FOR STORAGE TANKS

BACKGROUND OF THE INVENTION

1. Field of the Invention

The present invention relates generally to wall and/or panel systems and, more particularly, is concerned with a new and improved insulated panel system for storage tanks.

2. Description of the Prior Art

In the petroleum and chemical industries it is customary to store liquids and the like within large tank structures which are usually installed out in the open where they are exposed to the elements, both heat and/or cold. These storage facilities usually comprise circular steel or other metallic tank structures which by reason of being installed out in the open, must be provided with a suitable insulating material so that the products in storage within the storage tanks may be kept at the desired temperatures. In storage tank insulation systems, it has thus been customary to apply some type of an insulating material exteriorly of the metallic tank structure and to securely bind the same thereto by the use of an adhesive or by circumferential bands extending completely around the outside diameter of the tank and secured in a fixed position. Various arrangements or systems have been provided in the past for securing insulated panels to storage tanks. Representative patents in the general area of securing insulated panels to storage tanks are U.S. Pat. Nos. 2,323,297 (heat insulating construction); 2,501,951 (construction of tanks, silos, and like vessels); 3,456,835 (thermally insulated tank structure); 4,004,394 (method for insulation of curved surfaces); 4,044,517 (insulated tank jacketing system); 4,338,756 (panel and insulation system); 4,347,949 (insulated tank).

The manner of securing insulating panels to the exterior of a metallic storage tank has inherent problems for the reason that the tank structure is often times exposed to varying temperature gradients with the result that the metallic shell is caused to expand and contract due to such temperature variations. If an insulating material has been applied to the exterior surface of such a tank as by adhesively securing the same thereto, the adhesive bond between the metallic shell and insulating material is caused to be broken due to such expansion and contraction with the result that the insulating material is separated from the metallic shell with resultant loss of insulation for the tank at such spots and areas. In instances where the insulating material is secured to the tank structure as by means of exteriorly extending circumferential bands, the bands are usually set to a pretensioned force at the time of installation of the insulating material and when, by reason of differing temperature gradients, the tank walls are caused to expand and/or contract, the bands, which are usually formed of metal are incapable of further stretching to accommodate the expansion of the tank and insulating material thereof and will break or snap off thus necessitating the repair or replacement of such bands. On the other hand, where the tank structure is caused to contract, the metallic bands lose their efficiency as holding means for the insulating material since the bands are not exposed to the temperatures within the tank which causes such contraction of the metallic tank. Other arrangements have including welding anchoring studs to the outside wall of the tank structure and then fastening the insulated panels to these anchoring studs by means of metal screws or metal fasteners. The difficulty with such an arrangement is that at times the stud welding operation can expose explosion hazards, or the condition of a given tank wall is such that it would not readily accept a stud weld. Another draw back is that due to the expansion and contraction of the metal panels, the metal fasteners are worked out of the anchoring studs and thus the panels become loose.

One system concerned with the application of insulated panels to storage tank structures is described and illustrated in U.S. Pat. No. 4,122,640 to Commins, et al. The Commins, et al patent discloses an insulated tank jacketing system comprising panels having opposed side flanges, one of which includes a terminal bead and the other which includes a deformable sleeve that can be folded tightly about the bead of a similarly configured and adjacent channel section with an articulated fastener securing a pair of panel sections to a stranded wire cable, said fastener comprising a link element interposed between the side flanges of the adjacent panel sections and provided at one extremity with a bulbous rivetlike element insertable within and engageable with the interior wall of the bead of one panel section about which the sleeve of the adjacent panel section is folded.

While this system, or variations of it, can be used for an insulated tank jacketing system, it does have serious draw backs. First, the panel system described in Commins, et al involves greater costs in materials, labor and installation and greater inflexibility in panel design. The panels comprise upstanding and opposing side flanges each having a unique shape one of which includes a terminal bead and the other which includes a deformable sleeve that can be folded tightly about the terminal bead on a similarly configured and adjacent side panel. The unique features of the side flanges require greater costs in production. Since they are of a fixed shape, they cannot vary in width and cannot be shaped or formed at the job site. It would thus be advantageous for a panel system to employ simple panels that can very in length and width with straight opposed side flanges that could be formed at the job site for any length and width desired. This would result in a reduction of production costs of the panels and greater flexibility in on site designing and installation of the system. Second, the fasteners of the Commins, et al patent are more expensive to manufacturer and produce due to the unique shape of the articulated fastener and the various parts involved. The fastener has inherent features which could fail. Due to the constant expansion and contraction of all the components parts of the system, the rivet pin and/or the aluminum bulbous elliposoidal element plug could work or fall out causing the panels to become loose. Further, it takes time to install these fastening elements and special pneumatic or manual crimping tools are required to install these fastening elements both on the cable and within the terminal bead. It would thus be advantageous to employ an inexpensive continuous fastener which could be installed quickly without the necessity of special tools thus reducing labor costs. Third, the installation of the insulated tank jacketing system described in Commins, et al is labor intensive. The aluminum bulbous elliposoidal element plug of the fastening element must first be inserted into the mouth of the elongated bead section of one flange section, next the clamp portion of the fastening element must be crimped around the cable by use of a special pneumatic or hand crimping tool, next the elongated beaded section of the flange needs to be slightly crimped or collapsed on the opposite sides of the aluminum bulbous elliposoidal element plug by use of a crimping tool to prevent slippage, next the elongated sleeve of the adjacent panel flange must be folded about the elongated bead section of the previous panel by means of an electric power tool or the like provided with crimping rollers that engage the sleeve of the second panel and progressively crimp it about the elongated bead section of the flange. Obviously, this is very time consuming. It would be advantageous to again have an inexpensive continuous fastener which could be installed easily around the cable and attached to the side flanges without the use of any special pneumatic or manual crimping tools. Fourth, the method of attachment of the fastening elements could prevent cable movement and cause harmful stresses to build up within the cable. By utilizing stranded wire cables, the tank and wire cables will expand substantially uniformily relative to each other. The cable must be allowed to expand, roll or uncoil in the expansion process so that no undue stresses or movements will be imposed on the jacketing system and the components thereof. The fastening element in Commins, et al contemplates tightly crimping the base of the fastening element about the stranded cable. By doing so, this will prevent the cable from rolling or moving under expansion and could possibly cause deformation of the panels if the rivet pin in the fastening element stuck or failed for any reason. The Commins, et al patent further teaches that the base of the fastening element could be provided with a pair of anti-rotation wing-like tabs or prongs that could be adapted to rest against the wall of the tank so as to prevent any severe rotation of the clamp and fastening element. These anti-rotational wing-like tabs would also prevent any desired and required rotational movement or expansion of the cable relative to the tank which would prevent any undue stresses from building up in the cable. It would thus be advantageous for a fastening element to be employed in such a manner that would not restrict the expansion and contraction or rotational movement of the cable in any way but also firmly attach the panel section to the cable. Fifth, the method of joining adjacent flanges of panels sections together could possibly cause seam leakage and panel separation. The method taught in Commins, et al contemplates that the beaded section of the first flange is slightly crimped or collapsed on opposite sides of the aluminum bulbous elliposoidal element plug. This crimping leaves open air spaces in the form of two indentations on the surface of the beaded flange section. Thereafter, the elongated sleeve of the flange on the adjacent panel is folded about the elongated bead and over the indentations produced therein by means of an electric power tool which folds the elongated sleeve flange section over the elongated bead flange section. Thus, the intersurface of the elongated sleeve flange section is not flush against the outersurface of the elongated bead flange section. The indentations between the surfaces create open air spaces which could collect moisture and lead to rust, corrosion and overall weakening of the panel system. The constant expansion and contraction of the panels due to changes in temperature and hydrostatic pressures resulting from filling and emptying the tanks with liquids, etc., could cause the folded over sections of the flanges to open up over these indentations which could lead to loosing of the panels, leakage between the panels and possible corrosion of the tank wall. It would thus be advantageous to provide a continuous tight seal between the flanges on adjacent panel sections with no internal open air spaces between them.

Consequently, a need exists for improvements in insulated tank jacketing systems over the Commins et al patent which would solve the problems heretofore mentioned above by providing a totally closed sealed insulation jacketing system having no restriction of movement on any component part thereof and which would: result in greater reduction of material, labor and installation costs; provide for greater flexibility in on-site panel design and installation at reduced costs; allow for adequate expansion and contraction and movement of all parts of the jacketing system without build up of undue stresses; and produce a tighter seal between the adjacent panel flanges with no internal open air spaces.

SUMMARY OF THE INVENTION

The present invention provides an insulated tank jacketing system designed to satisfy the aforementioned needs. Accordingly, the present invention relates to an insulated tank jacketing system comprising a plurality of panels attached to a plurality of stranded steel cables arranged circumferentially on and about the outside surface of the tank wall, with means for securing and tightening each cable and further comprising continuous metal fasteners interposed around each cable and holding each panel thereto in such a manner that there is no restriction of the cable in expansion and contraction. More particularly, the panels are secured crosswise and against the cables with each panel comprising a channel shaped section having substantially upstanding and opposed straight side flanges of unequal or equal height. Insulating material can be affixed to the underside of each panel unit. The system contemplates the use of a continuous piece of strapping material or fastener which is looped around a stranded cable and brought up between adjacent panel sections and bent over the top of the shorter upstanding side flange of the panel. By attaching the fastener directly to the cable allows the cable to expand, contract, rotate and uncoil within the fastener without hindering the function of the fastener that being to hold the panels securely to the cable. The taller of the opposed straight flange of the adjacent panel is then bent over the strapping material fastener and over the top of the shorter opposed straight flange on the first mentioned panel. Then, both adjacent side flanges, with the strapping material fastener between them, are double rolled over each other by means of an electric power tool or the like so that a tight double closure seal is provided between the adjacent panels having no internal open air spaces present. By using panels having straight opposed side flanges, the panels can vary in length and width and the flanges can be formed from flat sheets of material shipped straight to the job site thus reducing the production costs of the panels themselves and providing greater flexibility in on-site panel design and installation. By use of a continuous piece of strapping material or fastener, the time required to install the panels are reduced. By having the continuous piece of strapping material or fastener looped and interposed around the cable and not fastened directly to the cable, allows the cable to move, roll and expand without building up any undue stresses therein. By allowing the flanges of adjacent panel sections to be folded and rolled over each other produces a double closure sealing joint which is far superior to crimping adjacent flanges over each other which could become uncrimped due to expansion from thermal changes.

DESCRIPTION OF THE PREFERRED EMBODIMENT

Figure 1:
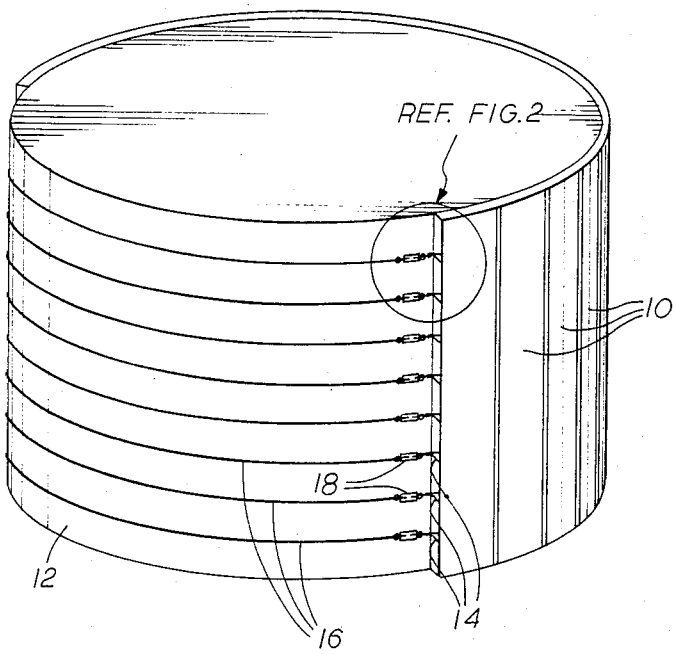
FIG. 1 is a isometric view of a conventional cylindrical storage tank structure provided with the improved insulated panel system of the present invention.
Figure 2:
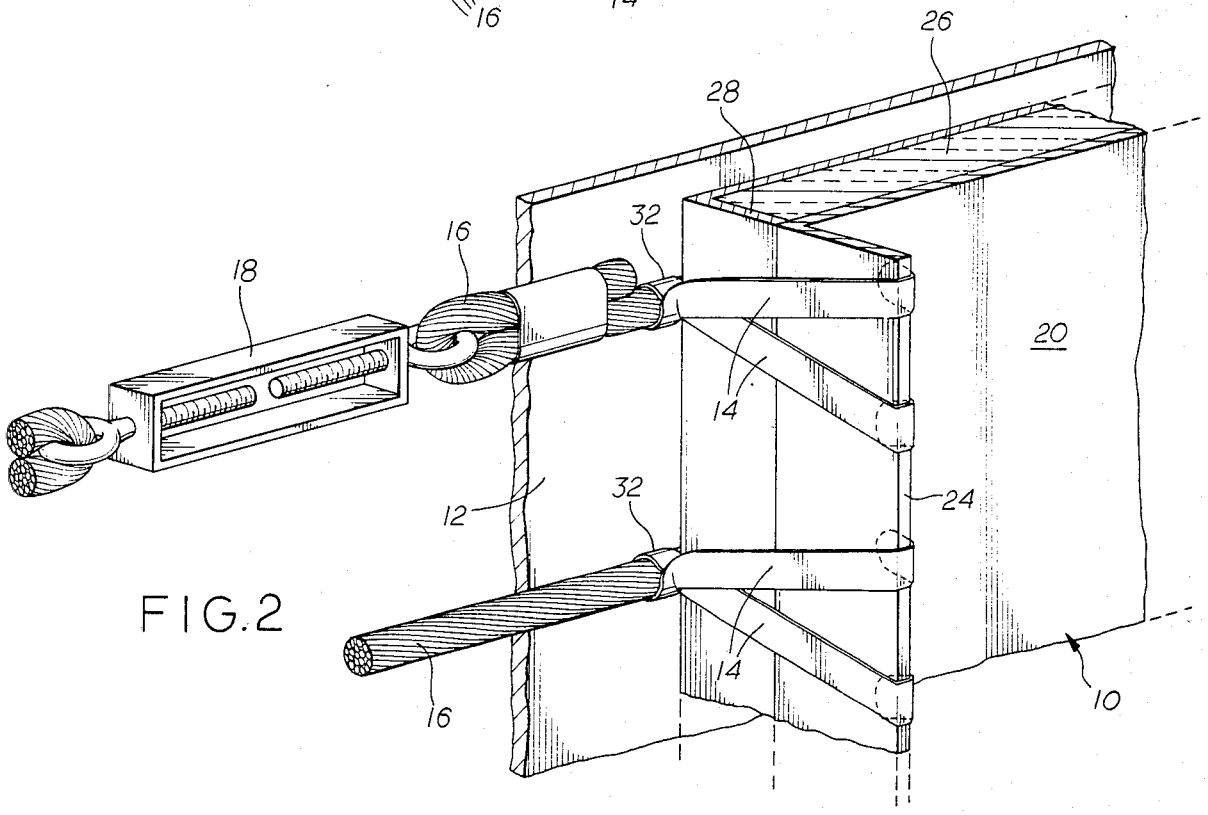
FIG. 2 is a fragmentary isometric view taken within the circumscribing circle 2 of FIG. 1 and illustrates the method of securing the insulated panel sections to the cables.

With reference to the drawings, and in particular FIGS. 1 and 2, a preferred embodiment of the instant invention is illustrated comprising panels 10 attached to the wall 12 of a typical conventional cylindrical storage tank structure by means of a continuous piece of strapping material or fastener 14 looped around a of stranded wire cable 16 held in place by turnbuckle 18.

Figure 3:
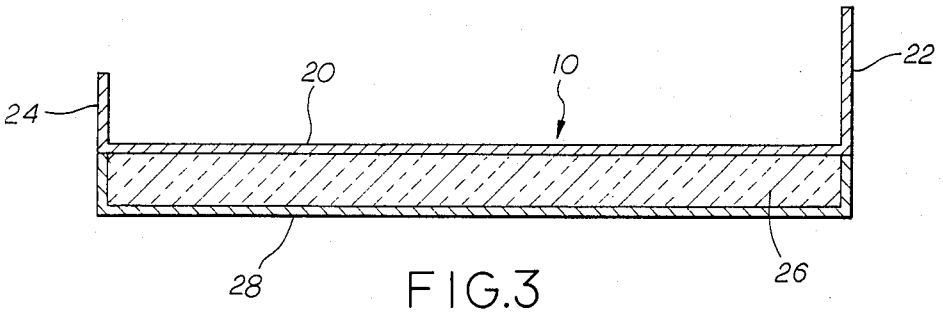
FIG. 3 is a sectional view of a typical panel section backed by a rigid insulating material layer.
Figure 4:
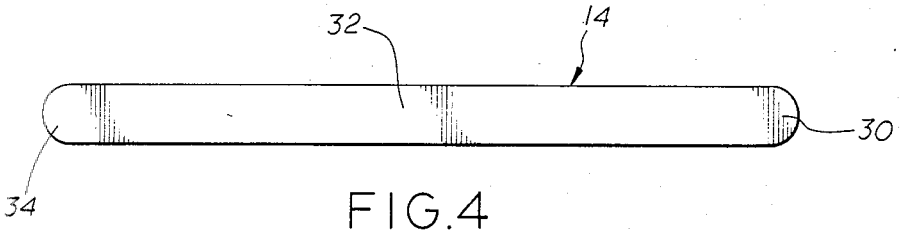
FIG. 4 is a plan view of the continuous fastener used with the present invention.
Figure 5:
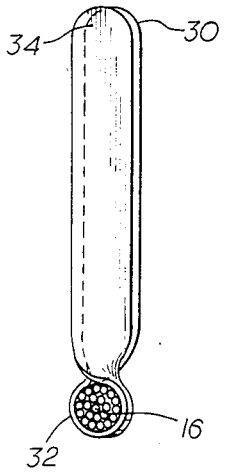
FIG. 5 is a vertical side elevation view of the continuous fastener looped around one cable according to the present invention.
Figure 6:
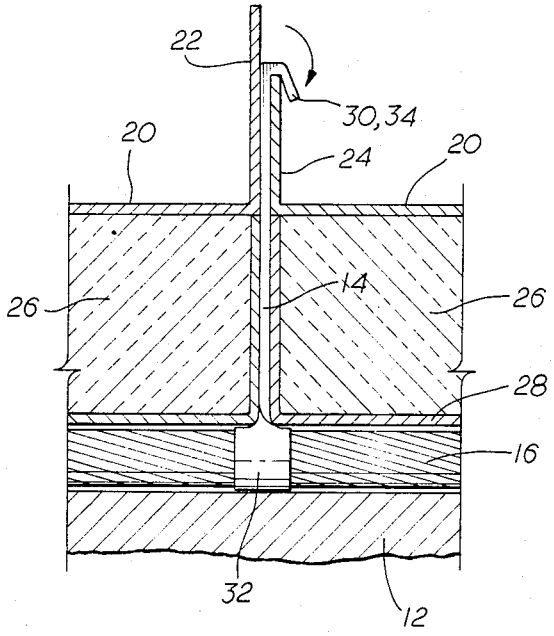
FIG. 6 is an elevation sectional view of the joint between a pair of panels with the continuous fastener of FIG. 4 being shown looped around the cable and interposed between said panels and bent over the top of the shorter flange on one adjacent panel pair to both flanges being rolled over.

Referring to FIG. 3, in conjunction with FIGS. 1 and 2, a panel 10 is generally comprised of a channel-shaped, roll formed metal section 20. The opposing edges of section 20 are provided with an upstanding and opposed straight first flange 22 and second flange 24 with said first flange 22 being slightly taller than second flange 24 so that the first flange 22 can be folded over the second flange 24 when a pair of such panels are disposed in adjoining relationship as shown in FIG. 6. Panel 10 can be backed with a suitable rigid insulating material layer such as one made of expanded polyurethane foam 26 secured to the underside of the panel. The exposed bottom surface of the insulating layer 26 can be further covered by a vapor barrier medium 28 of thin aluminum foil or another moisture impervious material well known in the art.

A plurality of metal bands or stranded wire cables 16 each of which is advantageously made up of a series of twisted steel wires are horizontally disposed in a generally parallel spaced arrangement on and about the outside surface of the tank wall 12. The ends of the wire cables 16 can be secured together by means of turnbuckles 18. After the various wire cables 16 are secured in place, panels 10 are affixed crosswise to the cables in the following fashion by means of the continuous piece of strapping material or fastener 14. Each fastener 14 is comprised of a thin continuous piece of strapping material having a first end 30, a middle section 32 and a second end 34.

Figure 7:
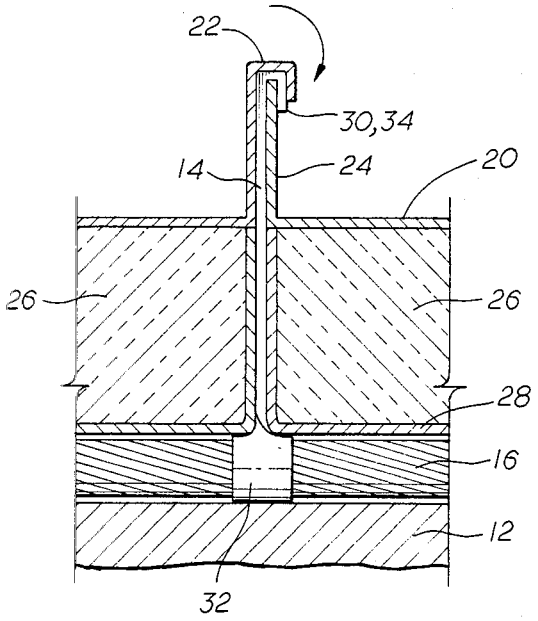
FIG. 7 is an elevation sectional view of the joint between a pair of panels after the first roll along the seam with a seaming tool.
Figure 8:
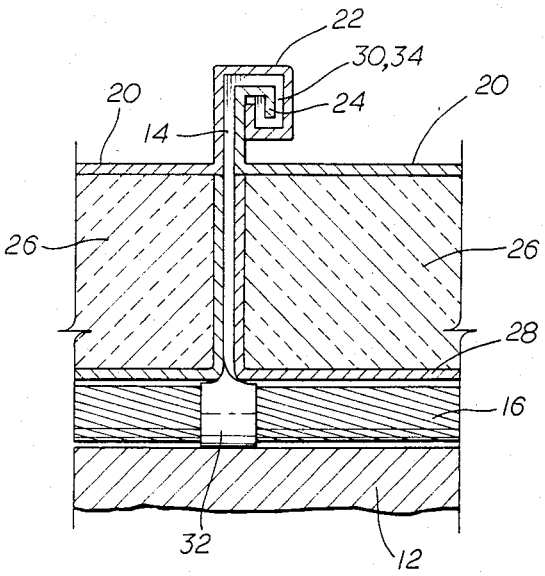
FIG. 8 is an elevation sectional view of the joint between a pair of panels after the second roll along the seam with a seaming tool showing the continuous fastener locked within the closure roll.

Referring now to FIGS. 5 through 8, in the insulation of the fastener 14 and attachment of the panels to the individual wire cables 16, it is contemplated that the fastener 14 would first be inserted around and under a cable 16 such that the middle section 32 of the fastener 14 rests around the periphery of the cable 16 with the first end 30 and second 34 end disposed 90° or rotated about the cable and placed in sided by side spaced relationship with respect to each other. Thereafter a panel is placed crosswise to the cable such that the second flange 24 of a panel 10 is in a spaced side by side relationship to the first end 30 and second end 34 of the fastener 14. The first end 30 and second end 34 of the fastener 14 are then bent over the top of the second flange 24 of the panel section 10. Thereafter, a second adjacent panel section 10 is placed in spaced relationship next to the first mentioned panel 10 having its first flange 22 placed next to the second flange 24 of the first mentioned panel 10 as illustrated in FIG. 6. Thereafter the upstanding first flange 22 of the second adjacent panel section is folded about the ends 30 and 34 of the fastener 14 and over the second flange 24 of the first mentioned panel 10 by means of an electric closure tool or the like provided with rollers that roll the first flange 22 of the second adjacent panel 10 over the fastener 14 and the second flange 22 of the first mentioned panel 10 as the closure tool is moved along the tank cover seam thus providing a closure seam as illustrated in FIGS. 6 and 7. Thereafter the same tool is once again moved along the seam formed by the adjacent flanges and the first flange 22 and second flange 24 are rolled over again with the finished closure seam being as illustrated in FIG. 8.

The tops of the panels 10 can fit within and below a tank overhang plate of appropriate design well known in the art while the bottoms of the panels can rest upon a block of insulation and/or a suitable base plate, etc., well known in the art.

By virtue of the aforesaid arrangement, the insulated panels 10 can be readily anchored to the stranded cables 16 by means of the continuous fastener 14 such that the cable 16 will be allowed to rotate due to the expansion and contraction of the system. The fastener 14 interposed around the steel cable in this manner will not cause any prevention of the expansion or movement of the cable. By allowing the first flange 22 to be double rolled over the fastener 14 and the second flange 24 of the first mentioned panel 10 allows for a continuous uninterrupted closure seam having no exposed joints for possible leakage and subsequent corrosion of the tank.

While the invention has been described with reference to a preferred embodiment, it will be obvious to one skilled in the art that modifications and variations of the invention may be constructed and employed without departing from the scope of the invention. The scope of the invention is defined in the following claims.

I claim:

1. A panel system for a storage tank wall and the like comprising:

a plurality of band means arranged circumferentially on and about the outside surface of the tank wall;

means for securing and tightening each of said band means;

a plurality of panels secured crosswise of and against said plurality of band means, each of said panels comprising first and second upstanding and opposed side flanges;

fastener means securing a pair of panels to each band means, each of said fastener means having two ends and a middle section with said middle section interposed around each of said band means with said two ends positioned between said first and said second upstanding and opposed side flanges of adjacent panel sections and folded over the top of said first side flange on one adjacent panel about which the second side flange of an adjacent panel section is rolled over said fastener means and said first side flange.

2. The system as set forth in claim 1 wherein said band means comprise stranded wire cables.

3. The system as set forth in claim 2 wherein said securing and tightening means comprise turnbuckles.

4. The system as set forth in claim 3 wherein said fastener means comprises a continuous thin strap.

5. The system as set forth in claim 4 wherein said continuous thin strap further comprises a continuous thin metal strap.

6. The system as set forth in claim 5 further comprising insulating material affixed to the underside of each panel.

7. A panel system for a storage tank wall and the like comprising:

a plurality of band means arranged circumferentially on and about the outside surface of the tank wall;

means for securing and tightening each of said band means;

a plurality of panels secured crosswise of and against said plurality of band means, each of said panels comprising a channel shaped section having upstanding and opposed first and second side flanges wherein said first side flange is taller than said second side flange;

fastener means securing a pair of panel sections to each band means, each of said fastener means having two ends and a middle section with said middle section interposed around said band means and said two ends positioned between the first and second side flanges of adjacent panel sections and folded over the top of the second side flange on one adjacent panel section about which the first side flange of an adjacent panel section is rolled over said fastener means and said second side flange.

8. The system as set forth in claim 7 wherein said band means comprise stranded wire cables.

9. The system as set forth in claim 8 wherein said securing and tightening means comprise turnbuckles.

10. The system as set forth in claim 9 wherein said fastener means comprises a continuous thin strap.

11. The system as set forth in claim 10 wherein said continuous thin strap further comprises a continuous metal strap.

12. The system as set forth in claim 11 further comprising insulating material affixed to the underside of each panel.

* * * * *